United States Patent [19]

Follis

[11] Patent Number: 4,844,391

[45] Date of Patent: Jul. 4, 1989

[54] SIGN MOUNTING STRUCTURE

[76] Inventor: John V. Follis, 1844 Mar Vista, Pasadena, Calif. 91104

[21] Appl. No.: 191,422

[22] Filed: May 9, 1988

[51] Int. Cl.[4] ..... G09F 7/02

[52] U.S. Cl. ..... 248/121; 40/606; 40/615; 248/159; 248/219.2

[58] Field of Search ..... 248/121, 159, 158, 219.2, 248/165; 40/606, 607, 615

[56] References Cited

U.S. PATENT DOCUMENTS

| | | | |
|---|---|---|---|
| 1,912,642 | 6/1933 | Lewis | 40/606 X |
| 2,694,540 | 11/1954 | Pfaff | 248/159 X |
| 3,237,330 | 3/1966 | Dinstbir | 40/606 X |
| 3,508,731 | 4/1970 | Jablonski | 248/219.2 |
| 3,526,050 | 9/1970 | Weller | 40/607 X |
| 3,742,870 | 7/1973 | Gusdorf | 248/158 X |
| 4,776,116 | 10/1988 | Shuman | 40/606 X |

FOREIGN PATENT DOCUMENTS

| | | | |
|---|---|---|---|
| 2014602 | 6/1978 | Fed. Rep. of Germany | 248/219.2 |
| 2280948 | 4/1976 | France | 40/606 |
| 87/4555 | 7/1987 | PCT Int'l Appl. | 40/606 |
| 29275 | 12/0000 | United Kingdom | 40/607 |
| 1326385 | 8/1973 | United Kingdom | 40/607 |

*Primary Examiner*—Alvin C. Chin-Shue
*Attorney, Agent, or Firm*—William W. Haefliger

[57] ABSTRACT

A supporting assembly for a sign enables sign mounting on an upright standard having an upper terminal portion, and defining an upright axis. The assembly includes:

(a) a collar located directly above and removably seated downwardly on the standard upper portion, (b) an armature integral with the collar and extending above the level of the collar, the armature having opposite upright sides, and sign structure embedding the armature and defining a sign outer surface offset from the armature side, (c) guide structure integral with the collar and extending downwardly therefrom in telescoping relation with the upper terminal portion of the standard, the guide structure having multiple ribs sidewardly engaging that upper terminal portion at locations spaced about the axis to block sideward tilting of the guide structure and of the armature, relative to the standard, and (d) a retainer means releasably retaining the guide structure to the standard upper terminal portion.

12 Claims, 3 Drawing Sheets

SIGN MOUNTING STRUCTURE

BACKGROUND OF THE INVENTION

This invention relates generally to the mounting of signs, and more particularly to an easily mountable and replaceable sign, that is rugged and durable.

Considering the amount of investment of signs, as in commercial developments and along roads and highways, and frequent vandalizing of signs, there is continued need for simple, durable, rugged, non fading, weather proof, and easily removable and replaceable sign structures.

SUMMARY OF THE INVENTION

It is a major object of the invention to provide an improved sign that meets the above need, and which also incorporates unusually advantageous structure, functioning and results, as will appear.

Basically, the sign is embodied in a unit that is replaceably mountable on an upright standard such as a steel or aluminum tube standard, or the like, and having an upright terminal portion defining an upright axis. The sign includes:

(a) a collar located directly above and removably seated downwardly on the standard upper portion, (b) an armature integral with the collar and extending above the level of the collar, the armature having opposite upright sides, and sign structure embedding the armature and defining a sign outer surface offset from both of the armature sides, (c) guide structure, integral with the collar and extending downwardly therefrom in telescoping relation with the upper terminal portion of the standard, the guide structure having multiple ribs sidewardly engaging said upper terminal portion at locations spaced about said axis to block sideward tilting, of the guide structure and of the armature, relative to the standard, (d) and retainer means releasably retaining the guide structure to the standard upper terminal portion.

As will appear, the standard upper portion is typically hollow, and defines a wall having an interior side surface extending about said axis, and said guide structure is received downwardly into said hollow, certain of the multiple ribs engaging the interior side surface. Also, the collar may advantageously include at least two downward local protrusions spaced about said axis, the protrusions seated on a rim, the collar having an annular under surface spaced directly above and from the rim.

Further, the retainer means extends between said wall and one of the ribs; and at least one protrusion is free of engagement with the wall interior side surface, the retainer means urging other of the ribs into engagement with said side surface.

The sign typically includes porcelain enamel protected outer surfaces or faces, formed on metal surfaces carried by lightweight structural foam plastic material embedding the grid-like armature, thereby saving weight and cost, while preserving externally high durability and ruggedness of the overall construction of the sign.

These and other objects and advantages of the invention, as well as the details of an illustrative embodiment, will be more fully understood from the following specification and drawings, in which:

DRAWING DESCRIPTION

DETAILED DESCRIPTION

Figure 1:
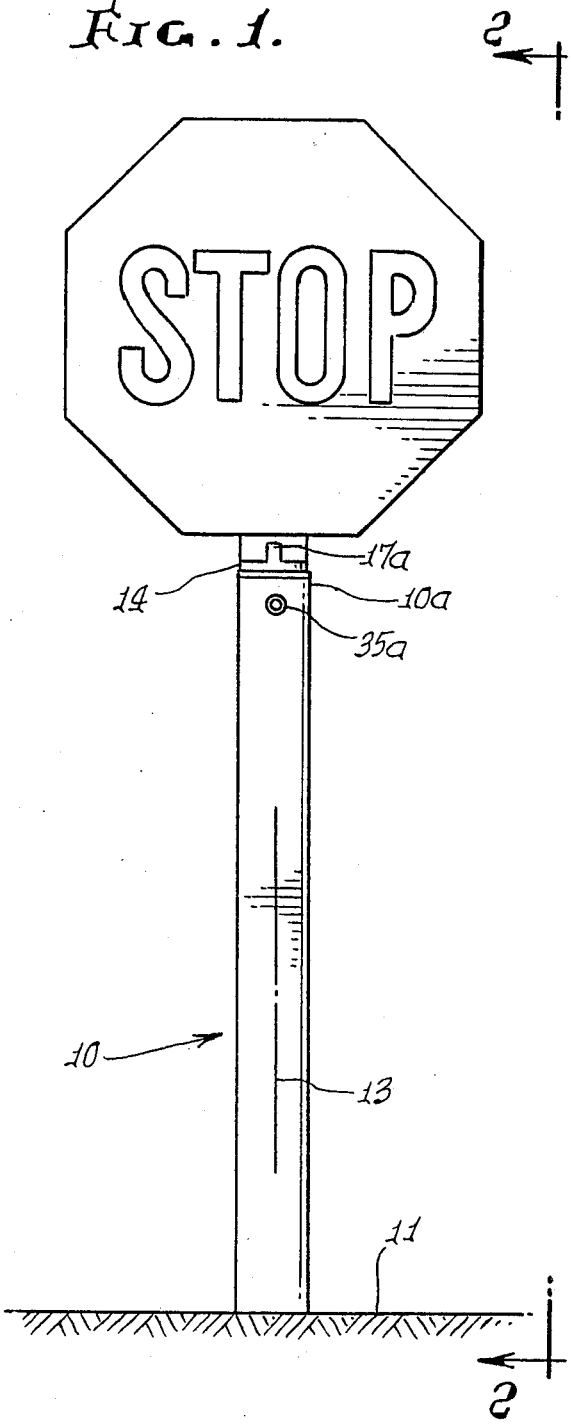
FIG. 1 is a front elevation showing a sign incorporating the invention.

In the drawings, an upright standard 10 has a lower end suitably supported as on a footing 11, and an upper terminal portion 10*a*. The standard may be a metal tube or pipe (and having an outer diameter of about 4 inches, for example), or it may have a non-circular cross-section (square, rectangular, etc.). The upright axis defined by the standard appears at 13.

Sign structure supported by the upper terminal portion includes a collar 14 located directly above, and removably seated downwardly on, the standard upper portion. Of advantage is the provision of at least two local protrusions 15, integral with and at the wider side of the collar, to seat on the upper rim 16 of the standard, the protrusions located 180° apart about axis 13. Accordingly, a positive support of the collar, with imposed sign weight is achieved, with a narrow annular space 16*a* provided between the bottom of the collar and the rim. The collar and integral protrusions consist of metal such as iron, cast ductile iron, or aluminum.

Figure 2:
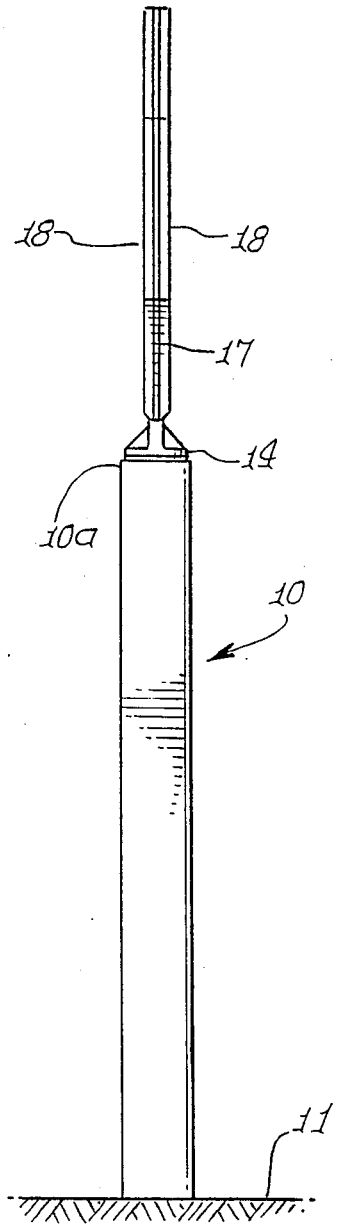
FIG. 2 is a side elevation on lines 2—2 of FIG. 1.
Figure 7:
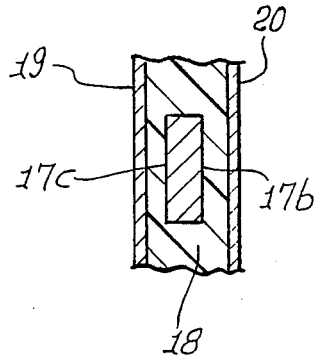
FIG. 7 is an enlarged fragmentary section showing embedding of the sign armature, and procelain enameled sign surfaces.

The collar supports the stem 17*a* of a like metal armature 17, projecting vertically and centrally above the collar, the armature extending generally in an upright flat plane (see FIG. 2), and being grid-like. The armature has flat, parallel, opposite sides 17*b* and 17*c* (see FIG. 7), and is embedded in sign structure which may advantageously include molded structural foam plastic (synthetic resinous) material 18, which is much lighter in weight than the rugged, virtually indestructible, armature made of cast ductile iron. Thus, should the sign be vandalized (as by shooting at it, etc.), the armature will keep the sign in position. Thin porcelain iron sheets 19 and 20 cover the opposite sides of the plastic material, and are typically coated with porcelain enamel in which the sign direction ("STOP", etc.) are formed. Such enamel is extremely weather resistant, and is non-rusting.

Guide structure 22 is integral with the collar, and extends downwardly therefrom, in telescoping relation with the upper terminal portion of the standard. The guide structure has multiple ribs, as at 23–30 projecting away from central ribbing 31, and toward the bore or inner surface 32 of the hollow standard 10, for engaging that surface, thereby to block tilting of the sign and armature; relative to the standard. The guide structure or "insert" 22 typically consists of metal, such as ductile iron. Central protrusions 23 and 24 are thicker and stronger than laterally spaced ribs 25, 26, 28 and 29, all such ribs and protrusions projecting in parallel relation. End ribs 27 and 30 project normal to ribs 25, 26, 28 and 29. The structure 22 is centrally positioned in the tube 10 by engagement of the ends of ribs 25–30 with the tube bore, ribs 24 and 25 acting as back-up support means.

Figure 6:
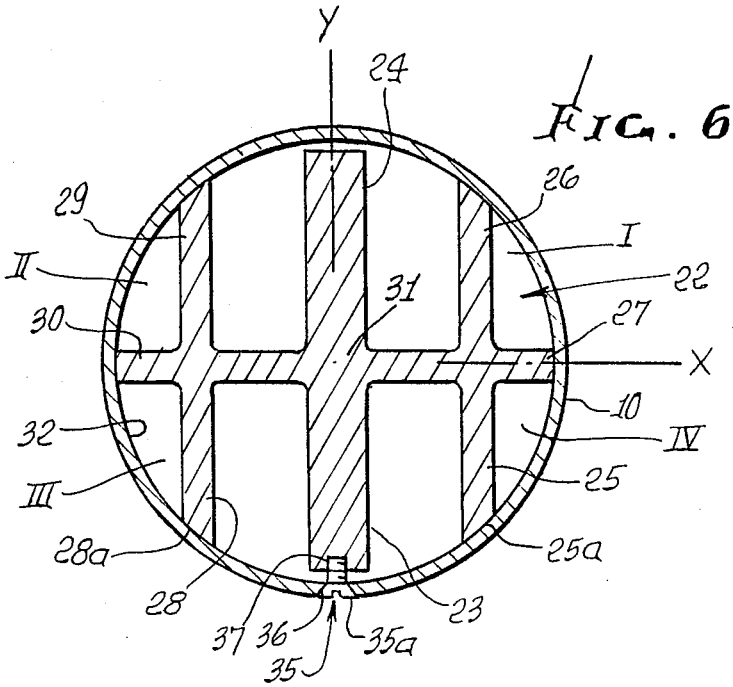
FIG. 6 is a section on lines 6—6 of FIG. 4.

Also, a retainer means releasably retains the guide structure to the standard upper terminal portion. See FIGS. 1 and 6, showing the retainer or fastener 35 having a head 35*a* received in a recess 36 in the wall of the standard, and a threaded shank 35*b* tightened into a threaded bore 37 in protrusion 23. This draws the ribs 25 and 28 into end engagement with the bore of the standard at 25*a* and 28*a*, to take up tolerance or clearance between the guide structure and the standard bore. Note that the ends of ribs 23 and 24 remain spaced from the pipe bore to allow such stabilized lateral support.

Figure 5:
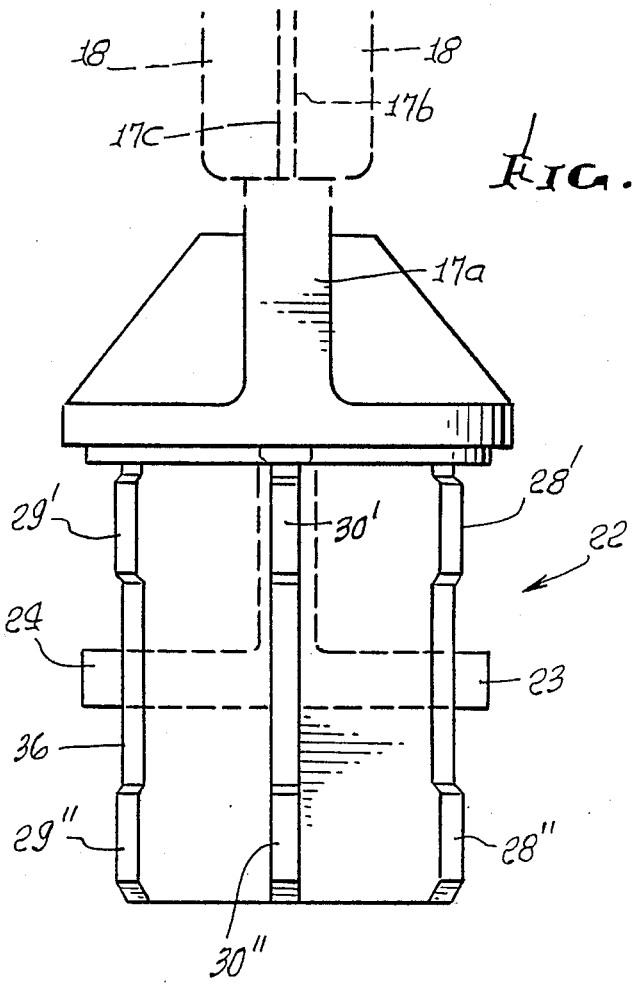
FIG. 5 is an elevation taken at right angles to the FIG. 4 structure.

FIG. 5 shows that each rib has upper and lower extents, as at 25' and 25", and 28' and 28", as shown. The ribs are relieved at 36 between their upper and lower extents to facilitate such reception of the guide structure into the standard. Such upper and lower extents, as at 25' and 25", engage the tube bore, as the fastener is tightened, providing structural support at locations 25', 25", 28' and 28". The rib ends, at such locations, are curved as shown to match the tube bore curvature.

Figure 3:
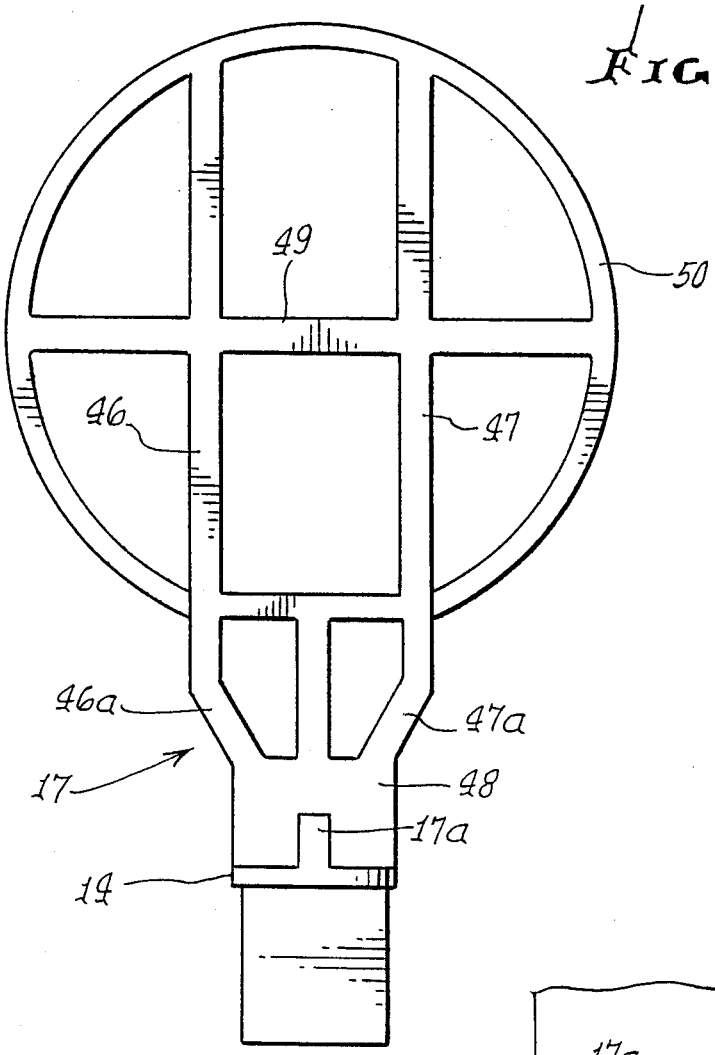
FIG. 3 is an elevation showing an armature which is incorporated in the sign structure.
Figure 4:
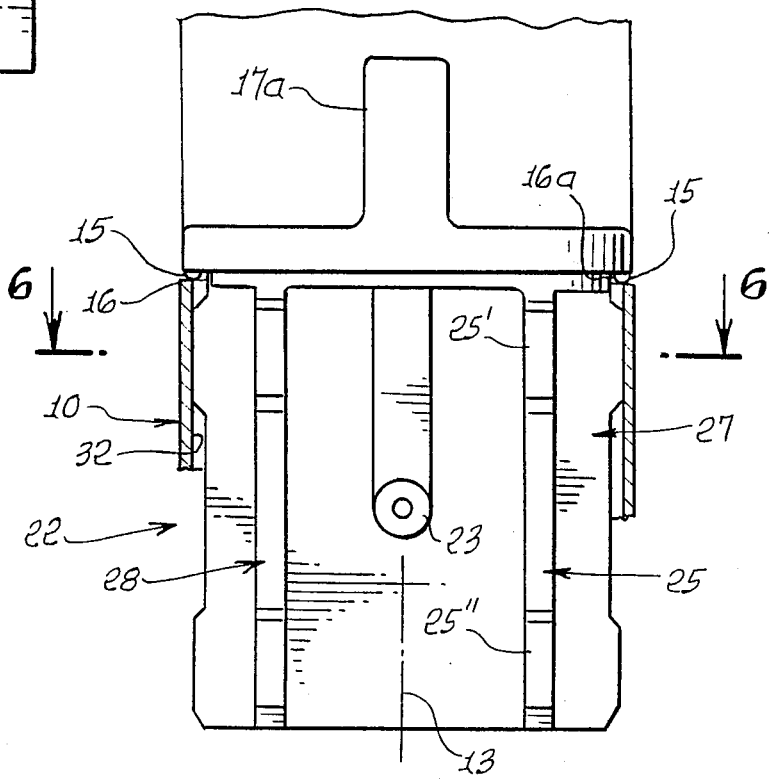
FIG. 4 is an enlarged side elevation showing guide and collar structure.

The metallic armature 17 also includes vertical ribs 46 and 47 converging at 46*a* and 47*a* with armature base 48, a lateral rib 49 intersecting ribs 46 and 47, and a peripheral looping rib 50 joined to ribs 47, and 49 as shown. See FIG. 3. All such ribs are embedded by the molded structural foam plastic material 18.

In FIG. 6, rib 27 extends in an axial and "x-axis" plane, protrusions 23 and 24 extend in an axial and "y-axis" plane; and ribs 26, 29, 28 and 25 extend in quadrants between such planes, as follows:

| Quadrant | Rib |
|---|---|
| I | 26 |
| II | 29 |
| III | 28 |
| IV | 25 |

Upon tightening of fastener, upper and lower sections 25', 25" and 28', 28" of ribs 25 and 29 are drawn tightly toward and against the tube bore, and the upper and lower sections 27', 27", 30' and 30" of ribs 27 and 30 engage the bore for added stability. Note, that ribs 26, 29, 28 and 25 may resiliently deflect somewhat in bending, due to their cantilever connections to ribs 27 and 30, to slidably fit the tube bore, upon insertion.

Accordingly, an extremely rugged, long lasting, easily mountable and replaceable sign structure is provided.

I claim:

1. In a supporting assembly for a sign enabling sign mounting on an upright standard having an upper terminal portion, and defining an upright axis, the combination comprising:

(a) a collar located directly above and removably seated downwardly on the standard upper portion, (b) an armature integral with the collar and extending above the level of the collar, the armature having opposite upright sides, and sign structure embedding the armature and defining a sign outer surface offset from both of the armature sides, (c) guide structure integral with the collar and extending downwardly therefrom in telescoping relation with the upper terminal portion of the standard, the guide structure having multiple ribs sidewardly engaging said upper terminal portion at locations spaced about said axis to block sideward tilting of the guide structure and of the armature, relative to the standard, (d) and retainer means releasably retaining the guide structure to the standard upper terminal portion, (e) said standard upper terminal portion being hollow and defining a wall having an interior side surface extending about said axis, and said guide structure being received downwardly into said hollow, certain of said multiple ribs engaging said interior side surface, (f) the collar having local downwardly facing shoulders seated on the standard upper portion, (g) said sign structure including porcelain enamel defining said sign outer surface, (h) said sign structure including synthetic resinous material embedding the armature, the armature being metallic and forming a grid, the procelain enamel located at an outer side defined by the synthetic resinous material, and the porcelain enamel substantially everywhere spaced from the armature, (i) the armature extending downwardly from the synthetic resinous material to define the only connection of the armature to the collar.

2. The combination of claim 1 wherein said standard upper terminal portion is tubular, and has an upper annular rim, and said collar is seated on said rim.

3. The combination of claim 1 wherein said retainer means extends sidewardly between said wall and one of said ribs.

4. The combination of claim 3 wherein said one rib is free of engagement with the wall interior side surface, the retainer means urging other of the ribs into engagement with said side surface.

5. The combination of claim 1 including said standard supporting the collar.

6. The combination of claim 1 wherein the armature includes spaced, intersecting ribs forming a flat, upright unitary structure embedded by said resinous material.

7. The combination of claim 6 wherein said armature ribs include at least two, upright, laterally spaced ribs, at least one laterally extending, generally horizontal rib, and a peripheral, looping rib joined to ends of the upright lateral ribs.

8. The combination of claim 6 wherein the sign includes two parallel, upright, porcelain enamel layers on opposite sides of the resinous material and exposed to the exterior.

9. In a supporting assembly for a sign enabling sign mounting on an upright standard having an upper terminal portion, and defining an upright axis, the combination comprising:

(a) a collar located directly above and removably seated downwardly on the standard upper portion, (b) an armature integral with the collar and extending above the level of the collar, the armature having opposite upright sides, and sign structure embedding the armature and defining a sign outer surface offset from both of the armature sides, (c) guide structure integral with the collar and extending downwardly therefrom in telescoping relation with the upper terminal portion of the standard, the guide structure having multiple ribs sidewardly engaging said upper terminal portion at locations spaced about said axis to block sideward tilting of the guide structure and of the armature, relative to the standard, (d) and retainer means releasably retaining the guide structure to the standard upper terminal portion, (e) said standard upper terminal portion being hollow and tubular and defining a wall having an interior side surface extending about said axis, and said guide structure being received downwardly into said hollow, certain of said multiple ribs engaging said interior side surface, (f) the standard upper terminal portion having an upper annular rim, the collar including at least two downward local protrusions spaced about said axis, said protrusions seated on the rim, the collar having an annular under surface space directly above and from the rim.

10. In a supporting assembly for a sign enabling sign mounting on an upright standard having an upper terminal portion, and defining an upright axis, the combination comprising:

(a) a collar located directly above and removably seated downwardly on the standard upper portion, (b) an armature integral with the collar and extending above the level of the collar, the armature having opposite upright sides, and sign structure embedding the armature and defining sign opposite outer surfaces offset from the armature sides, (c) guide structure integral with the collar and extending downwardly therefrom in telescoping relation with the upper terminal portion of the standard, the guide structure having multiple ribs sidewardly engaging said upper terminal portion at locations spaced about said axis to block sideward tilting of the guide structure and of the armature, relative to the standard, (d) and retainer means releasably retaining the guide structure to the standard upper terminal portion, (e) said sign structure including porcelain enamel defining said sign outer surfaces, (f) said sign structure including synthetic resinous material embedding the armature, the armature being metallic and forming a grid, the porcelain enamel located at opposite outer sides defined by the synthetic resinous material, and the porcelain enamel spaced from the armature, (d) the armature extending downwardly from the synthetic resinous material to define the only connection of the armature to the collar.

11. In a supporting assembly for a sign enabling sign mounting on an upright standard having an upper terminal portion, and defining an upright axis, the combination comprising:

(a) a collar located directly above and removably seated downwardly on the standard upper portion, (b) an armature integral with the collar and extending above the level of the collar, the armature having opposite upright sides, and sign structure embedding the armature and defining a sign outer surface offset from the armature sides, (c) guide structure integral with the collar and extending downwardly therefrom in telescoping relation with the upper terminal portion of the standard, the guide structure having multiple ribs sidewardly engaging said upper terminal portion at locations spaced about said axis to block sideward tilting of the guide structure and of the armature, relative to the standard, (d) retainer means releasably retaining the guide structure to the standard upper terminal portion, (e) said standard upper terminal portion being hollow and defining a tube bore with a wall having an interior side surface extending about said axis, and said guide structure being received downwardly into said hollow, certain of said multiple ribs engaging said interior side surface, (f) said multiple ribs extending in vertical parallel relation and spaced about said axis, and each rib having upper and lower sections which are spaced apart lengthwise of the tube bore, and which protrude toward said interior side surface, (g) the retainer means including a retainer extending sidewardly through said standard upper terminal portion wall and into said guide structure, at a level between the upper and lower sections of the ribs closest to the retainer, the guide structure being metallic.

12. The combination of claim 11 wherein said multiple ribs include four ribs respectively extending in four quadrants of a cylinder defined by the tube bore, the guide structure consisting of ductile iron and including intermediate vertical rib means between and spaced from two of said four ribs, the retainer means attached to said intermediate rib means at a locus where the intermediate rib means is spaced from said interior side surface wall.

* * * * *